US006283038B1

(12) United States Patent
Mattila

(10) Patent No.: US 6,283,038 B1
(45) Date of Patent: Sep. 4, 2001

(54) PROFILE RAIL JOINT

(75) Inventor: Veijo Mattila, Iittala (FI)

(73) Assignee: KCI Konecranes International PLC, Hyvinkää (FI)

( * ) Notice: Subject to any disclaimer, the term of this patent is extended or adjusted under 35 U.S.C. 154(b) by 0 days.

(21) Appl. No.: 09/510,175

(22) Filed: Feb. 22, 2000

(30) Foreign Application Priority Data

Feb. 22, 1999 (FI) ..... 990377

(51) Int. Cl.[7] ..... E01B 24/25
(52) U.S. Cl. ..... 104/89; 104/93; 104/109
(58) Field of Search ..... 104/89, 93, 94, 104/95, 108, 118, 109, 140; 198/860.1, 660.2

(56) References Cited

U.S. PATENT DOCUMENTS 3,974,777 * 8/1976 Monne ..... 104/94
5,400,717 3/1995 Hoehn .
5,443,151 8/1995 Taylor .
5,598,784 * 2/1997 Kubsik et al. ..... 104/111

FOREIGN PATENT DOCUMENTS

505892-C2 * 10/1997 (SE) ..... E01B/25/24
C2505892 * 10/1997 (SE) ..... E01B/25/24

* cited by examiner

*Primary Examiner*—S. Joseph Morano
*Assistant Examiner*—Frantz F. Jules
(74) *Attorney, Agent, or Firm*—Birch, Stewart, Kolasch & Birch, LLP

(57) ABSTRACT

A profile rail joint for use for example in light crane systems has connecting ends of profile rails to be joined, provided with jointing sleeves arranged on side surfaces of the rails, the sleeves comprising through holes for locking devices of the joint, and at least two of the sleeves being situated in profile recesses of the rails. The joint also includes guide elements extending over the joint surface for aligning the connecting ends. At least two jointing sleeves provided in the profile recesses are arranged such that the bottom of the recess and the side wall of the jointing sleeve are spaced apart at least over a section of the sleeve's length, the guide elements for the joint being placed in resulting intermediate spaces.

8 Claims, 2 Drawing Sheets

PROFILE RAIL JOINT

BACKGROUND OF THE INVENTION

The invention relates to a profile rail joint for use for example in light crane systems, the joint comprising connecting ends of profile rails to be joined, provided with jointing sleeves arranged on side surfaces of the rails, the sleeves comprising through holes for locking means of the joint, and at least two of the sleeves being situated in profile recesses of the rails, the joint further comprising guide elements extending over the joint surface for aligning the connecting ends.

Swedish Patent 505,892 discloses a substantially similar profile joint as described above. In this publication, control means consist of interacting guide surfaces, such as conical male and female surfaces, provided at the ends of jointing sleeves of the profile rails to be arranged one against the other. This Swedish Patent also discloses a separate annular guide element provided between the ends of the jointing sleeves, and the guide surfaces are arranged between the end of the sleeve and the end of the guide element.

The aforementioned Swedish Patent does not describe in greater detail the formation of the guide surfaces. In fact, interacting guide surfaces cannot be formed in a joint that is made without a separate connecting piece, at least not after the jointing sleeves have already been mounted in place at the ends of the rail. For example, it is virtually impossible to form afterwards a male cone that would protrude from the joint surface, let alone other possible shapes of the guide surface. Therefore the guide surfaces must be formed in the sleeves before they are welded in place. Unless the sleeves are exactly aligned, it is also likely that only conical guide surfaces will work satisfactorily. On the other hand, the use of separate connecting pieces requires four guide surface to be provided in each joint surface to be arranged against another surface. This, in turn, requires a great deal of work and accuracy. Furthermore, separate short connecting pieces tend to fall off when a joint is being made.

U.S. Pat. No. 5,400,717 discloses a connection arrangement comprising welded alignment bushings and aligning pins inserted into the bushings to achieve proper alignment of the connection. However, the bushings are not used, nor can they be used to provide lead-throughs for fastening bolts or, in general, to tighten the connection. To form a connection, the lateral surfaces of the profiles are provided with separate fastening flanges.

U.S. Pat. No. 5,443,151 discloses a similar arrangement as described above, but alignment grooves corresponding to the alignment bushings are provided in an aluminium alloy profile already during the manufacture thereof and not afterwards through welding, as in the case of the alignment bushings. Also in this patent, the alignment grooves are entirely separate from the fastening bolts, since here, too, the fastening means are mounted afterwards in web sections of the profiles.

BRIEF DESCRIPTION OF THE INVENTION

It is an object of the present invention to improve the profile rail joint described at the beginning so as to solve the aforementioned problems related to the alignment of the rails. This is achieved by means of a profile rail joint according to the invention, which is characterized in that at least two jointing sleeves provided in the profile recesses are arranged such that the bottom of the recess and the side wall of the jointing sleeve are spaced apart at least over a section of the sleeve's length, and that the guide elements for the joint are placed in resulting intermediate spaces.

The basic idea of the invention is to provide a space for separate guide elements while mounting the jointing sleeves in place or forming them in the profile recesses. The only requirement is that a sleeve is not arranged at the bottom of the recess as in the prior art arrangements, but it is placed such that a space is formed in the recess for a separate guide element to be placed therein. Naturally, the rear part of the sleeve may comprise an enlargement facing the recess and extending all the way to the bottom thereof. Such an enlargement would require a special sleeve but it would also set the sleeve at a correct distance from the recess. The space for the guide element could also be provided by forming an additional hollow at the bottom of the profile recess or in the wall of the jointing sleeve. However, wall thicknesses do not usually allow this.

The present invention provides important advantages for example over the arrangement of Swedish Patent 505,892. In the novel arrangement according to the invention, the jointing sleeves do not have to be shaped or changed in any way, but existing sleeves can be used. The only requirement is that a space of a suitable size is provided between the bottom of the profile recess and the jointing sleeve for the guide element to be used, which can be for example a folded sheet-like or pin-like piece. Consequently, the arrangement according to the invention achieves alignment with minimum costs, since the space for the guide element is formed at the same time when the jointing sleeve is being mounted in place, and the only additional part that is required is the simple guide element described above. It is also easy to align the joint, since the elongated guide element can be inserted into a space provided in the other profile to be joined such that it cannot fall off. A transverse protrusion or enlargement that is preferably formed in the middle of the guide element also tightens the ends of the rails be joined so that they are exactly aligned in the cross direction.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE FIGURES

The invention will be described below in greater detail by means of preferred embodiments with reference to the accompanying drawings, which are given by way of illustration only, and thus are not limitative of the present invention, and in which.

DETAILED DESCRIPTION OF THE INVENTION

Figure 1:
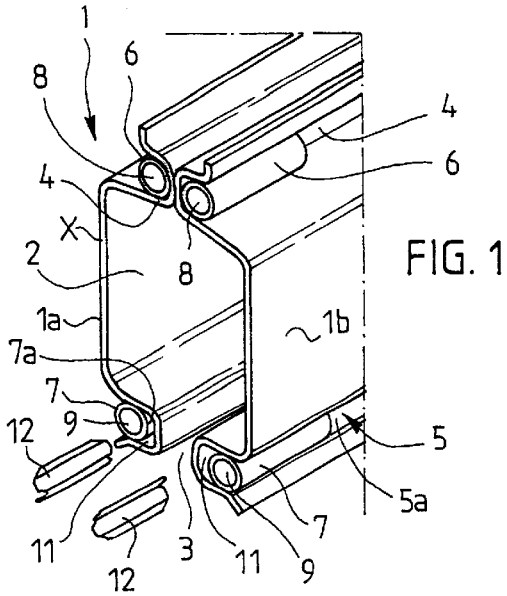
FIG. 1 is a perspective view of a profile rail and a guide element for use in a preferred embodiment of a profile rail joint according to the present invention.
Figure 2:
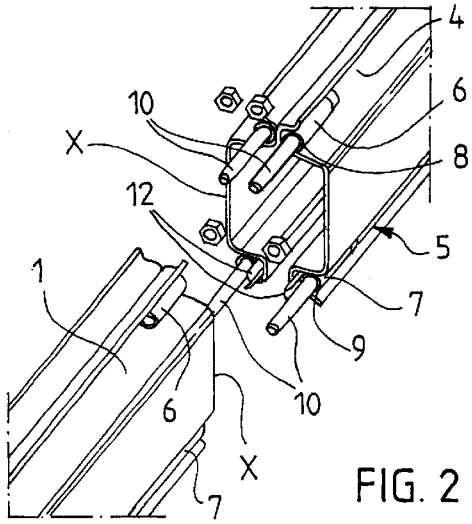
FIG. 2 shows the profile rail joint according to the invention in an exploded view by means of the profile rail and the guide elements of FIG. 1.

FIGS. 1 to 4 show a profile rail 1 intended particularly for light crane systems, where crane wheels (not shown in the figures) are movably located in a profile recess 2 of the rail, and the crane (not shown) is suspended below the rail 1 and the profile recess 2 thereof and is connected to the wheels via a longitudinal opening 3 provided under the recess 2. The profile rail 1 shown in the figures is formed of two longitudinally profiled halves 1*a* and 1*b* joined from their upper ends. The profile rail 1 formed in this manner comprises longitudinal external upper recesses 4 and lower recesses 5, which result from the shaping of the profile halves 1*a* and 1*b* and which are directed outwards from the vertical sides of the rail 1.

To form a butt joint of two rails 1 as described above, the recesses 4 and 5 at the ends of the rails 1 are provided with longitudinal jointing sleeves 6 and 7, which comprise axial through holes 8 and 9 for fastening bolts 10 of the joint to be made. In this example the upper jointing sleeves 6 are arranged at the very bottom of the recesses 4, whereas the jointing sleeves 7 are provided in the recesses 5 such that the bottom 5*a* of the recess and a side wall 7*a* of the jointing sleeve 7 are spaced apart. During the joining, the resulting intermediate spaces 11 are provided with guide elements 12 extending over the joint surface X to align the connecting ends of the rails 1 in the transverse direction. The guide element 12 is an elongated piece made of sheet material and provided with a longitudinal middle crease 12*a* and longitudinal side creases 12*b* on opposite sides of the middle crease 12*a*. The cross-section of the guide element thus corresponds substantially to a V that is placed on its side.

Figure 3:
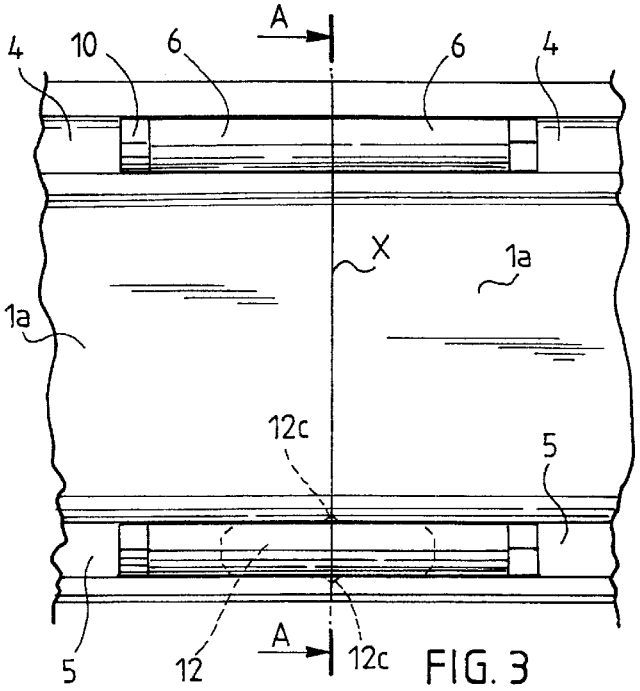
FIG. 3 is a side view of a joint made by means of the elements shown in FIGS. 1 and 2.
Figure 4:
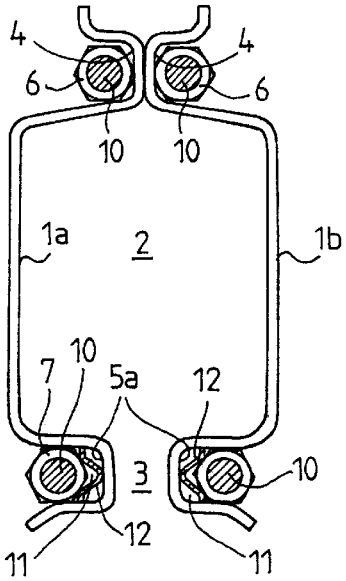
FIG. 4 shows a section of the joint of FIG. 3, taken along the line A—A.
Figure 5:
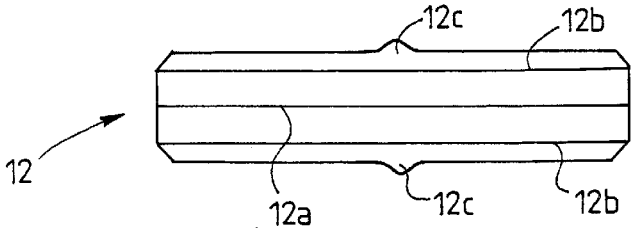
FIG. 5 is a side view of the guide element shown in the preceding figures.

On both sides of the guide elements 12 in the middle thereof in the longitudinal direction there are transverse protrusions 12*c* which ensure that during the joining the guide element 12 is inserted an equal distance into the intermediate space 11 provided at the connecting end of each rail 1 to be joined, and which fasten the connecting ends in exact alignment in the transverse direction (see especially FIGS. 3 and 4).

The guide element 12 can be formed of a spring-like material, such that the height thereof on both sides of the transverse protrusions 12*c* exceeds the height of the intermediate space 11. Therefore, when the guide element is being inserted into place, it is locked therein and cannot fall off during the installation.

To receive the transverse protrusion 12*c*, the rail 1 or the jointing sleeve 7 can be provided with a corresponding recess (not shown).

In connection with FIGS. 1 to 4 it should be noted that two guide elements 12 suffice to align the joint, even though naturally the guide elements could also be mounted in connection with the upper jointing sleeves 6 as described above. Alternatively, one guide element can be associated with the upper sleeve 6 and one with the lower sleeve 7. These alternatives are not shown separately.

Figure 6:
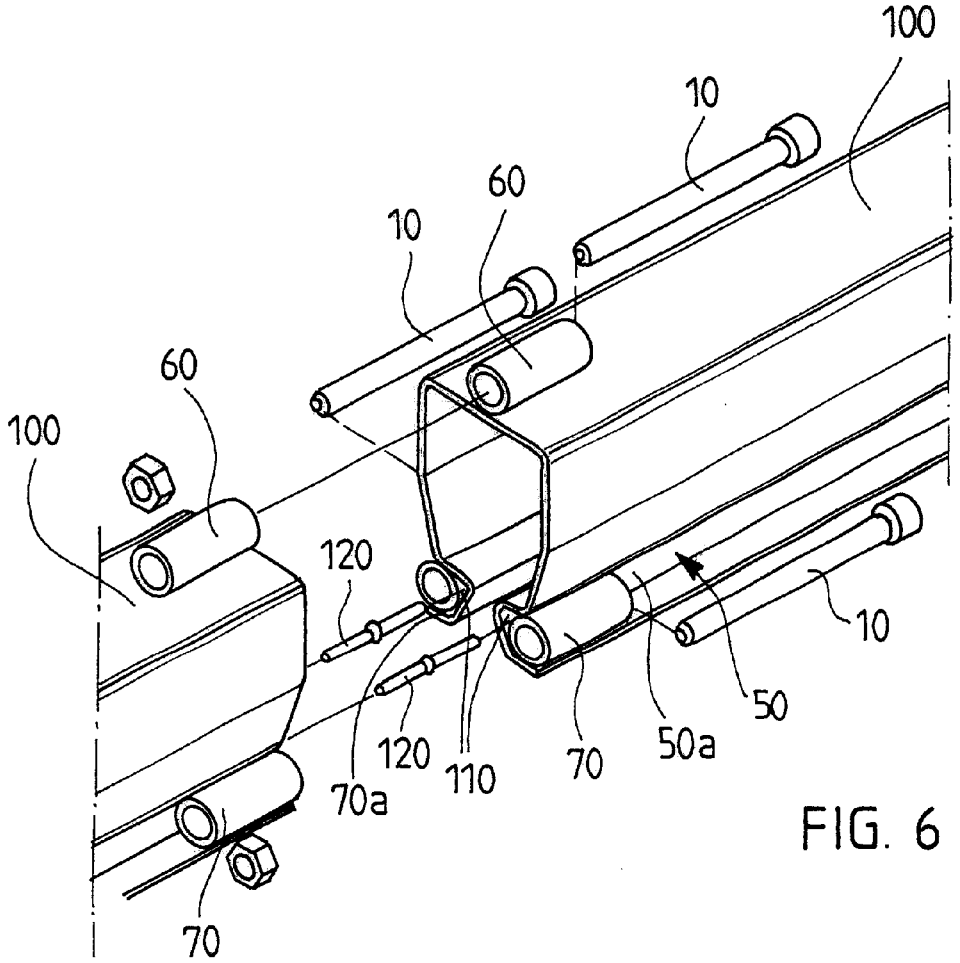
FIG. 6 shows the profile rail joint according to the invention in an exploded view by means of another profile rail and guide element.
Figure 7:
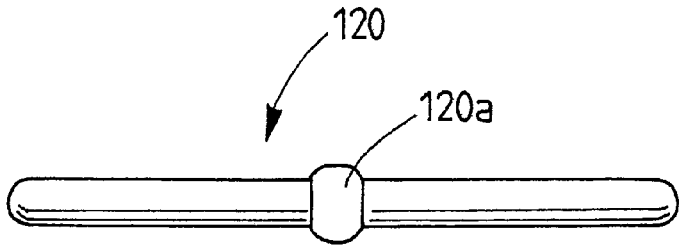
FIG. 7 is a side view of the guide element shown in FIG. 6.

The profile rail 100 shown in FIG. 6 differs from the profile rail 1 of FIGS. 1 to 4 in that it is formed of a one-piece profile. Furthermore, the even upper surface of the connecting end of each rail 100 to be joined comprises only one jointing sleeve 60, whereas recesses 50 provided at the bottom of the rail comprise similar jointing sleeves 70 as shown in FIGS. 1 to 4. However, the cross-sectional shape of an intermediate space 110 situated between a side surface 70*a* of the jointing sleeve and the bottom 50*a* of the recess is substantially triangular, and correspondingly, guide elements 120 to be inserted into the recesses 50 are pin-like pieces (provided with a round cross-section, for example) comprising in the middle an enlargement 120*a* (FIG. 7). The operation and function of the enlargement correspond to the transverse protrusions 12*c* of the guide element 12 described above.

The above description of the invention is only intended to illustrate the basic inventive concept. However, those skilled in the art can implement the details thereof in several alternative manners within the scope of the appended claims.

What is claimed is:

1. A profile rail joint the joint comprising connecting ends of profile rails to be joined, provided with jointing sleeves arranged on side surfaces of the rails, the sleeves comprising through holes for locking means of the joint, and at least two of the sleeves being situated in profile recesses of the rails, the joint further comprising guide elements extending over the joint surface for aligning the connecting ends, wherein at least two jointing sleeves provided in the profile recesses are arranged such that the bottom of the recess and the side wall of the jointing sleeve are spaced apart at least over a section of the sleeve's length, and the guide elements for the joint are placed in resulting intermediate spaces.

2. A profile rail joint according to claim 1, wherein the guide element is an elongated piece made of sheet material, comprising at least one longitudinal crease.

3. A profile rail joint according to claim 2, wherein the elongated guide element provided with a crease is formed of a spring-like material, and the height thereof exceeds the height of the intermediate space, whereby the element becomes locked when it is being inserted into place.

4. A profile rail joint according to claim 2, wherein the middle of the guide element comprises in the longitudinal direction at least one transverse protrusion, which ensures that during the joining the guide element is inserted an equal distance into the intermediate space of each profile to be joined, and which fastens the ends to be connected in exact alignment.

5. A profile rail joint according to claim 4, wherein the transverse protrusion interacts with a corresponding recess provided in the rail or the jointing sleeve.

6. A profile rail joint according to claim 1, wherein the guide element is a pin-like piece.

7. A profile rail joint according to claim 6, wherein the pin-like guide element comprises in the middle an enlargement, which ensures that during the joining the guide element is inserted an equal distance into the intermediate space of each profile to be joined, and which fastens the ends to be connected in exact alignment.

8. A profile rail joint according to claim 7, wherein the enlargement interacts with a corresponding recess provided in the rail and/or the jointing sleeve.

* * * * *